United States Patent [19]

Middleton

[11] 4,306,413

[45] Dec. 22, 1981

[54] HYDRAULIC POWER AND CONTROL SYSTEM

[75] Inventor: Frederic H. Middleton, Madison, Wis.

[73] Assignee: The United States of America as represented by the Secretary of the Navy, Washington, D.C.

[21] Appl. No.: 591,378

[22] Filed: Jun. 30, 1975

[51] Int. Cl.[3] ..... F16D 31/02; B63G 8/00

[52] U.S. Cl. ..... 60/478; 60/484; 91/529; 114/322; 114/48

[58] Field of Search ..... 114/16 A, 16 G, 48, 114/312, 321, 322, 48; 60/325, 478, 484; 91/529

[56] References Cited

U.S. PATENT DOCUMENTS

| | | | |
|---|---|---|---|
| 2,745,317 | 5/1956 | Stanton et al. | 89/46 |
| 3,440,825 | 4/1969 | Lloyd | 60/478 |
| 3,442,240 | 5/1969 | Wild et al. | 114/16 |
| 3,443,483 | 5/1969 | Ruhl | 91/529 |
| 3,572,032 | 3/1971 | Terry | 60/478 |
| 3,788,425 | 1/1974 | Balogh | 91/529 |
| 3,817,153 | 6/1974 | Zunzer | 91/529 |

*Primary Examiner*—Sal Cangialosi
*Attorney, Agent, or Firm*—R. S. Sciascia; Ervin F. Johnston

[57] ABSTRACT

A hydraulic power and control system which includes a pump which is mounted in a sealed housing. The pump is mounted in the sealed housing along with a pilot operated power valve. The pump has an inlet within the housing for intaking oil therein and is connected to the pilot operated power valve for operating components in a functional system, such as a submersible docking apparatus. The pilot operated power valve discharges oil into the sealed housing and is connected to a control valve which is located exterior of the housing. The control valve will pilot operate the power valve and discharges oil within the sealed housing. The control valve may be mounted within a pressure casing which receives a reduced oil pressure from the pump within the sealed housing. The sealed housing may be pressure compensated to ambient so that the pressure casing is maintained at a specific pressure level above ambient. Further, the control valve in the pressure casing may have push buttons which sealably extend exteriorly therefrom for operation by a diver.

19 Claims, 22 Drawing Figures

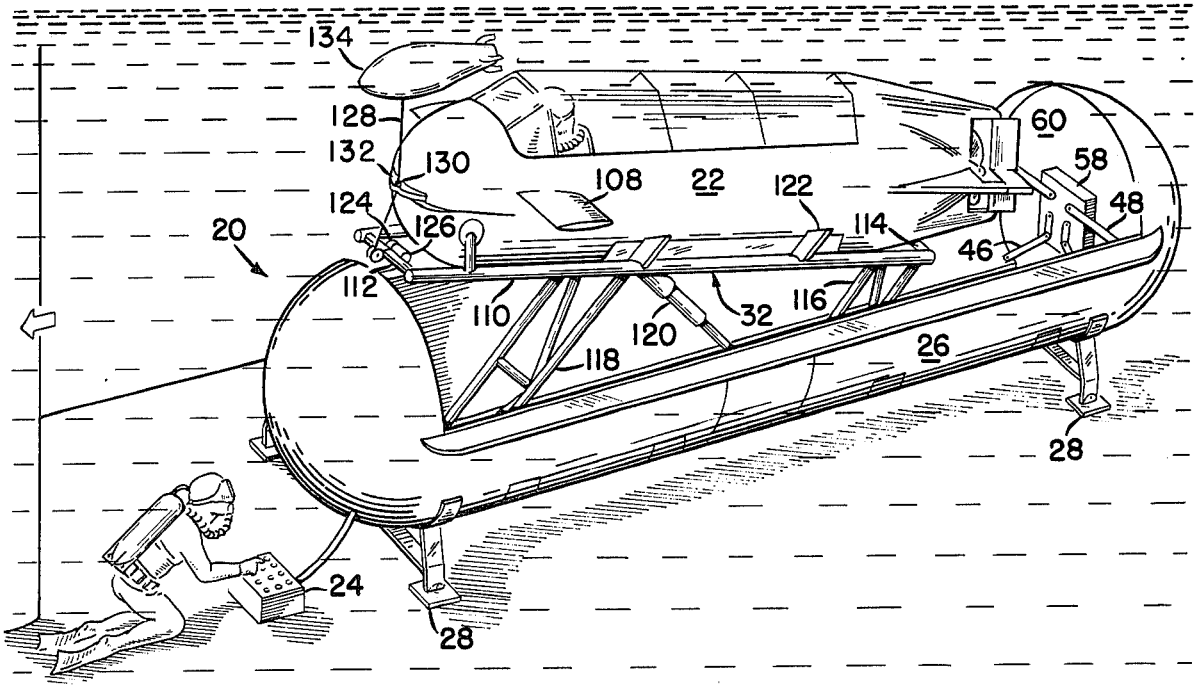
FIG.5
FIG.6
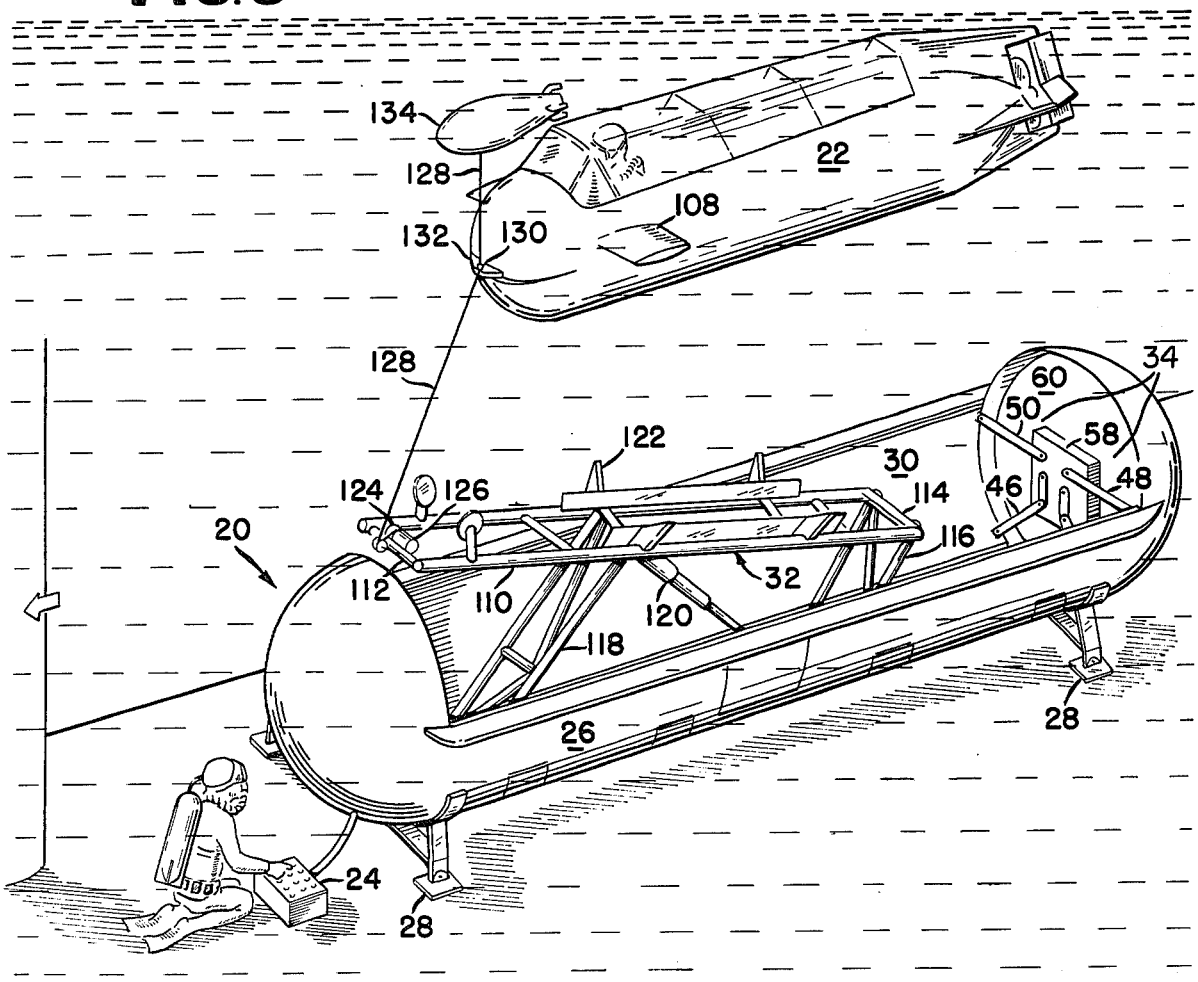

HYDRAULIC POWER AND CONTROL SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

There is little commercially available control and power hardware for undersea applications. Therefore, most applications require adaption of presently existing hardware which requires sea proofing and sometimes major modifications. Most common undersea working hardware is probably electrical in nature and is prone to corrosion, electrolytic action, current leakage, and insulation and coupling problems. When this hardware is combined with mechanical jacks, winches, gear boxes, and so forth, the problems magnify because of the interfacial leakage paths, and mechanical stresses.

Pneumatic equipment is available to some degree, but even with more limited selection than electrical equipment. Pneumatic equipment is handicapped by the energy storage problem (compressed air), and also leaves a signature in the form of air bubbles. As operational depth increases, efficiency decreases.

Hydraulic equipment has the most attractive features for underwater use, however, very little of this equipment is available. The use of standard surface-hydraulic equipment in an underwater environment creates immense corrosion problems and is difficult to control with standard or modified electrical, mechanical, or pneumatic control equipment.

SUMMARY OF THE INVENTION

The invention is a hydraulic power and control system which can be used to operate an exemplary submersible docking system. The invention may include a hydraulic power package which has pump means and valve means for operating the exterior components. The power package is established at ambient by a pressure compensator.

A control valve means, which is connected to the pump means under reduced pressure, is utilized for pilot operating the power valve means. A hydraulic control package may be provided for containing the control valve means and the latter may have push button means which extend through the control package for control by an operator.

OBJECTS OF THE INVENTION

An object of the present invention is to provide a hydraulic power and control system which can efficiently operate within a submerged environment.

Another object is to provide a hydraulic power and control system which is sealed and has minimum interfacing with exterior components.

A further object is to provide a hydraulic power and control system wherein the hydraulic power is within a main package at ambient and the control system is within an auxillary package which is powered at a reduced pressure from the main package.

Still another object of the invention is to provide a hydraulic power and control system which has a minimum of interfacing and wherein push buttons can be simply depressed to operate exterior components.

Still another object is to provide a hydraulic power and control system which can be operated in a submerged environment with a mimimum of interfacing, corrosion, or leakage problems.

These and other objects of the present invention will become more readily apparent from the ensuing specification when taken together with the drawings.

BRIEF DESCRIPTION OF THE DRAWINGS

FIG. 5 is an isometric view of the hangar in an open position with the underwater vehicle elevated to a desired launch position.

FIG. 6 is an isometric view of the hangar with the underwater vehicle payed out by a release line into the moving water.

DESCRIPTION OF THE PREFERRED EMBODIMENT

Figure 1:
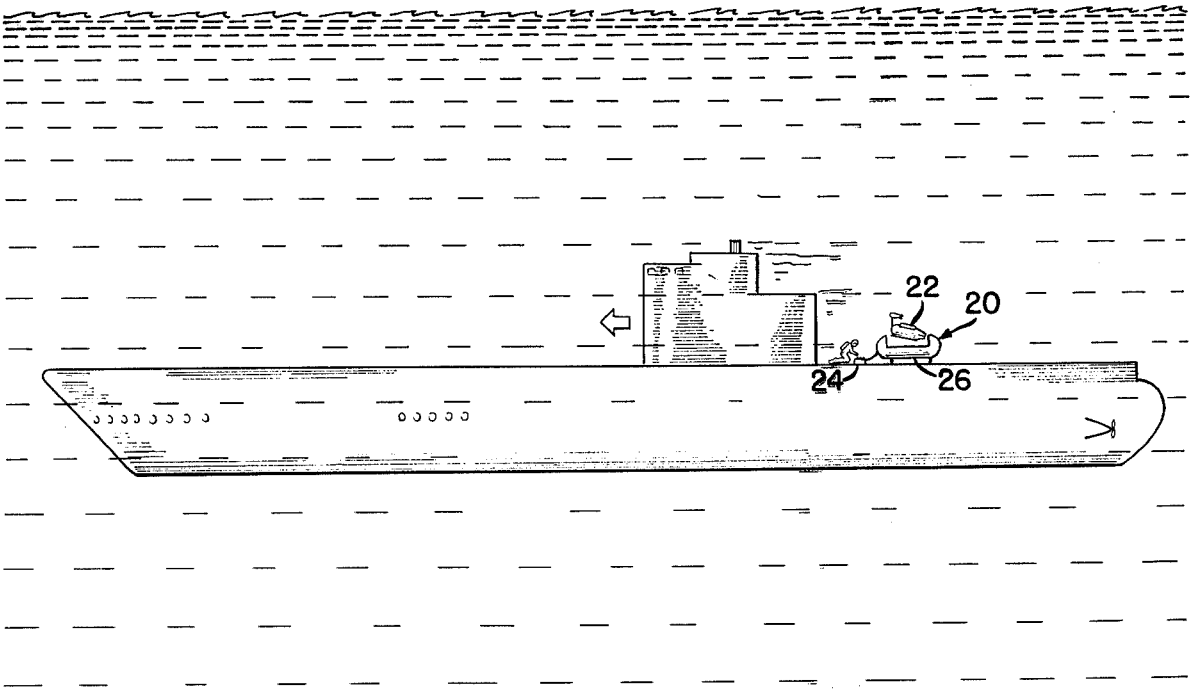
FIG. 1 is an ocean elevation view of an underwater vehicle ready for launch from a container type hangar which is mounted on the deck of a submarine.
Figure 16A:
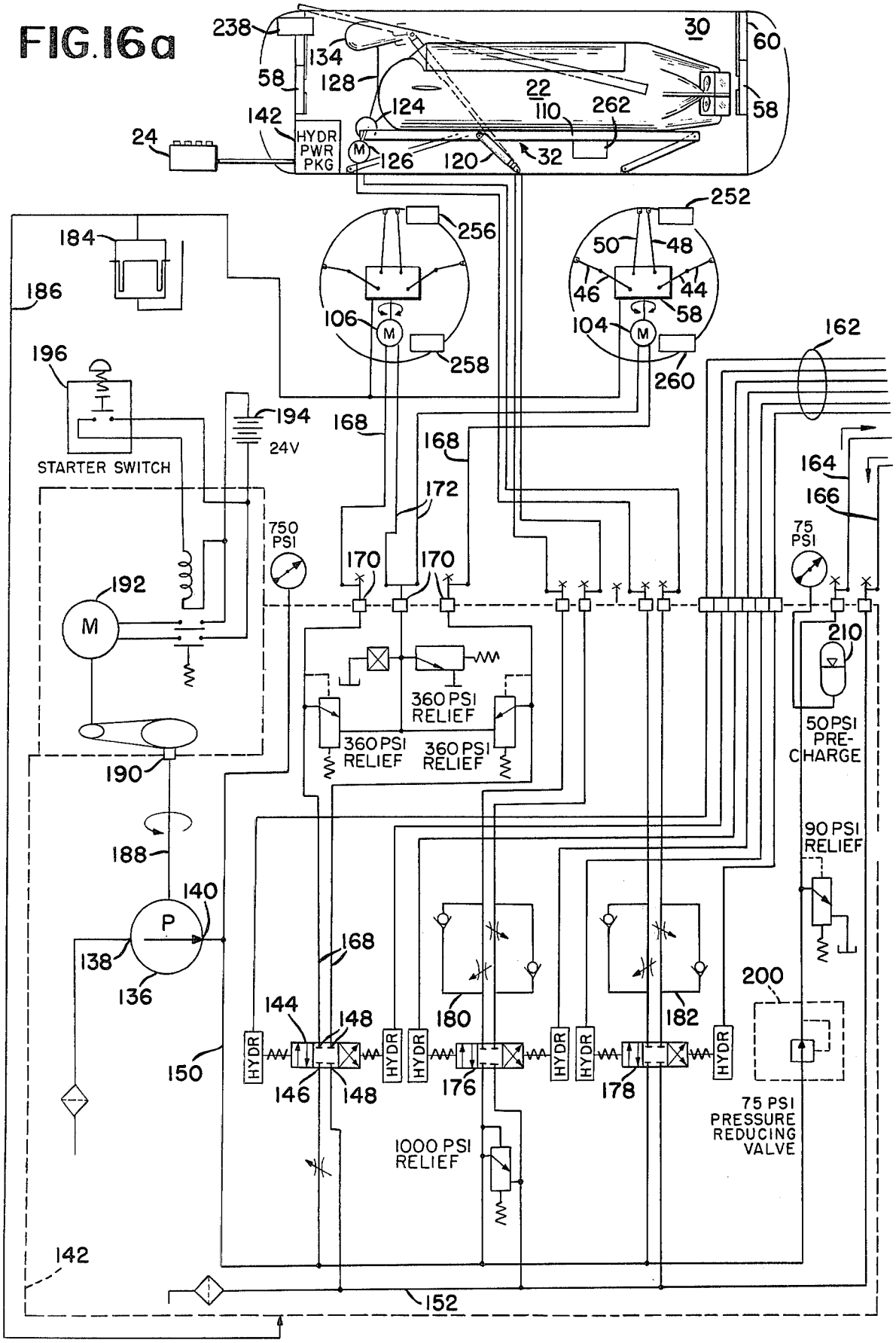
FIGS. 16*a* and 16*b* are a schematic illustrations of the hydraulic power and control system for operating the various components of the exemplary docking systems.
Figure 16B:
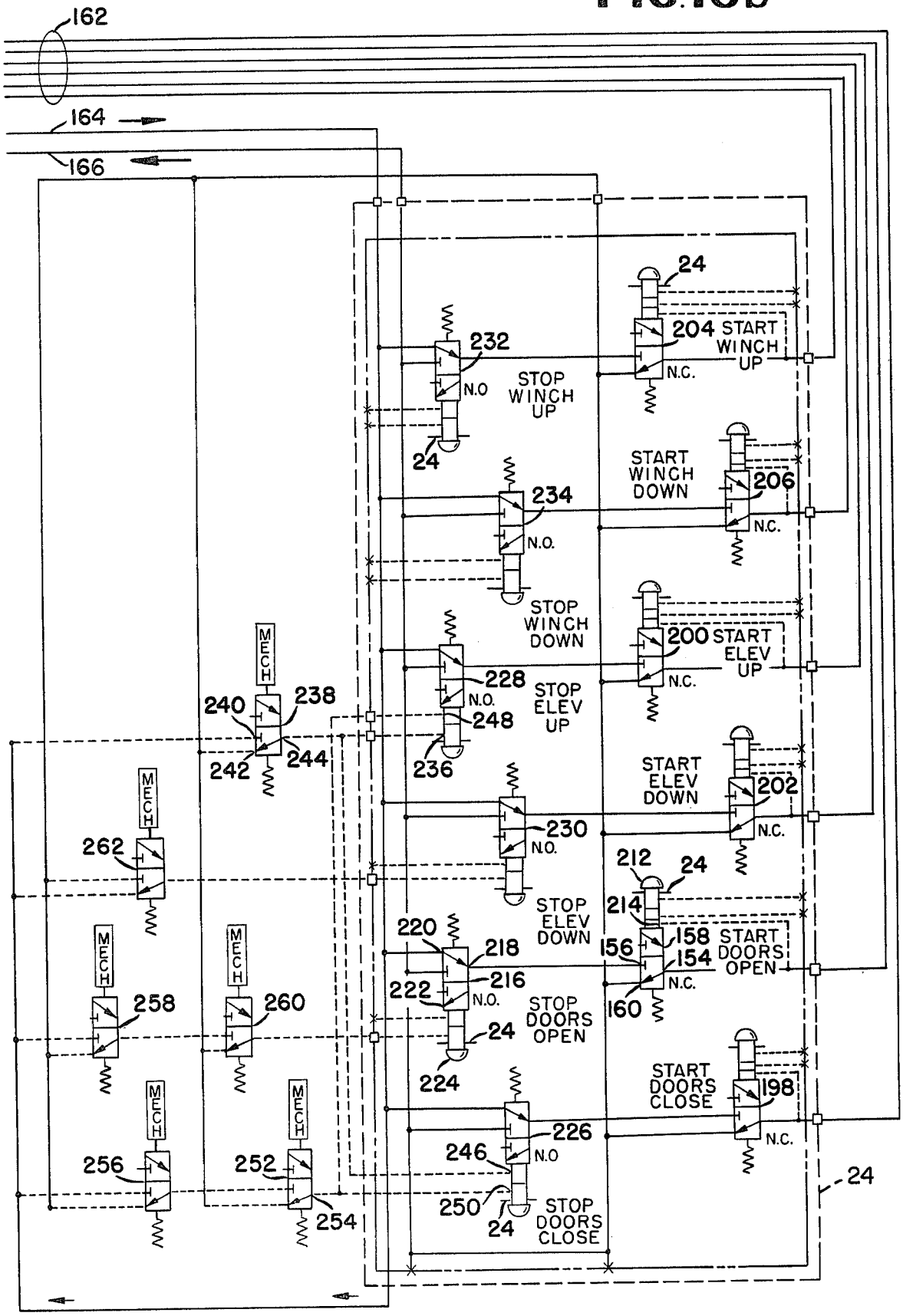

Referring now to the drawings, wherein like reference numerals designate like or similar parts throughout the several views, there is illustrated in FIG. 1 a system 20 for docking, releasing and recovering an underwater vehicle 22 from the deck portion of a submarine while the submarine is underway at a reduced speed. The docking system 20 is an exemplary system which can be operated by the present invention, and will be described prior to describing the hydraulic power end control system. The hydraulic power and control system is illustrated in FIG. 16 and is described in detail under the caption "Hydraulic Power and Control System".

Figure 2:
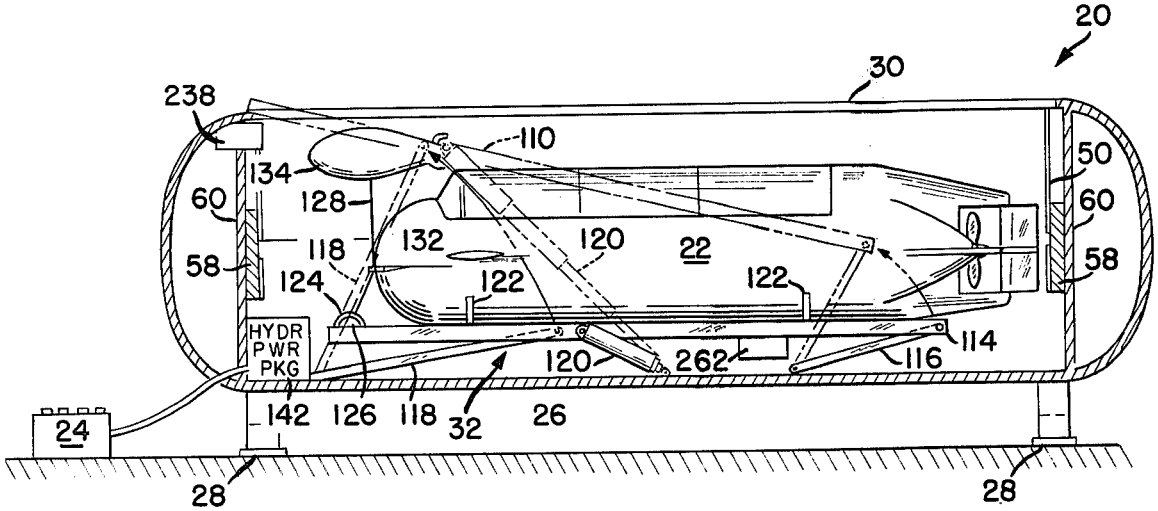
FIG. 2 is a longitudinal, cross-sectional view of the hangar showing the underwater vehicle in a down position.
Figure 3:
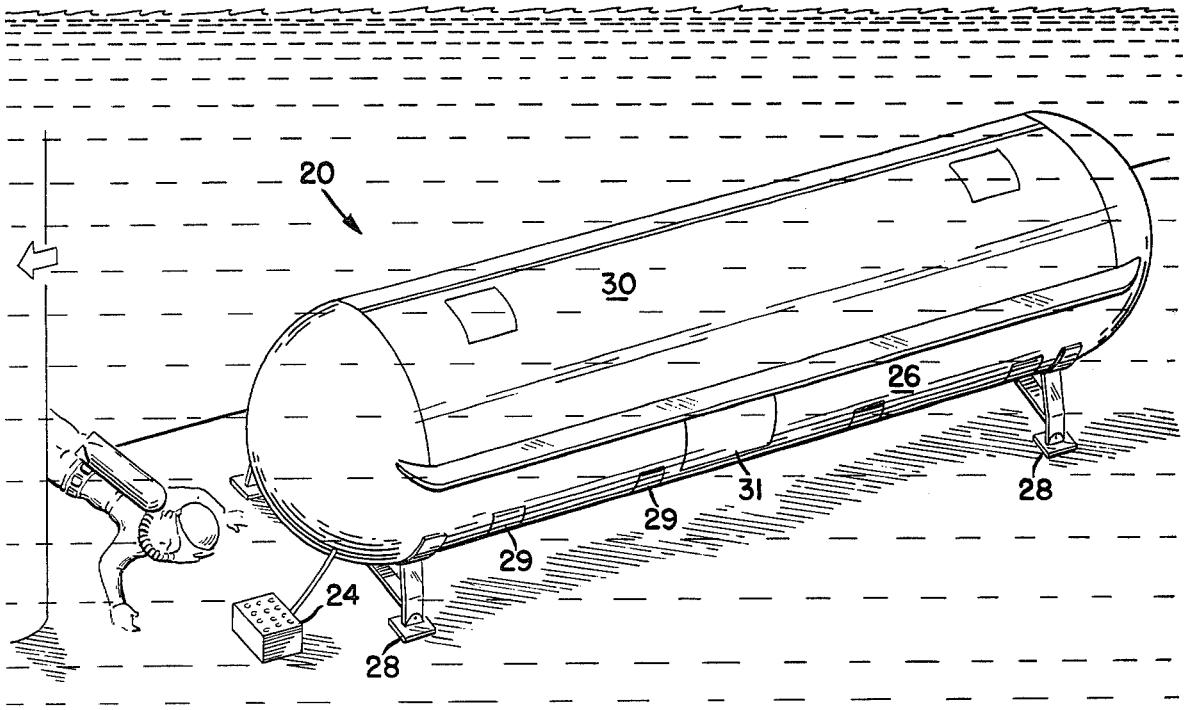
FIG. 3 is an isometric view of the hangar in a closed position on the deck of the submarine.

The docking system 20, which may be controlled from a push-button sealed casing 24, may include an elongated container 26 which is capable of being mounted on the deck of the submarine by any suitable means such as leg and cleat combinations 28. As illustrated in FIG. 2, the container 26 is capable of containing the underwater vehicle 22, and as illustrated in FIG. 3 may have flapper valves 29 for effecting free flooding or draining of water from the container. The container has top door means 30 which are capable of being opened for release or recovery of the underwater vehicle 22. This top door means, which will be described in more detail hereinafter, is illustrated in FIGS. 3 through 12*b*. As illustrated in FIG. 3, the container 26 may also have a hatch 31 so that divers can enter or exit the container.

As illustrated in FIG. 2, the docking system further includes elevator means 32 which is mounted in the container 26 for raising and lowering the underwater vehicle through the top of the container when the door means 30 are open. The elevator means elevates the underwater vehicle with its nose higher than the tail so that its bow planes will be in a preferred position for lift. The elevator means, which will be described in more detail hereinafter, is also illustrated in FIGS. 2 through 7.

Means may be provided for opening the door means inside the container without interference with the underwater vehicle 22 when it is contained therein. As illustrated in FIG. 3 and FIGS. 8*a* through 12*b*, a top cylindrical portion of the container is split longitudinally into a pair of doors 30 so that the doors are flush with one another as well as with the remainder of the container when in their closed positions, as more specifically illustrated in FIG. 3. Further, lever means 34 (see FIG. 6) is mounted within the container 26 for oppositely directing the doors downwardly and inside the container in a generally cupped relationship with the inside concave surfaces of the container (see FIGS. 8*a* through 12*b*). With this arrangement the container presents a smooth configuration when the doors are closed and minimum interference with the flow stream and the inside of the container when the doors are opened. This is important to the transport, launch, and recovery of the underwater vehicle.

LEVER MEANS

As illustrated in FIGS. 8*a* through 12*b*, the lever means may include two pairs of output shafts 36 and 38, and 40 and 42. The lever means may further include two pairs of toggle jointed arms 44 and 46 which connect the pair of output or toggle arm shafts 36 and 38 respectively to lower portions of the doors 30, and a pair of actuator arms 48 and 50 which connect the other pair of output shafts 40 and 42, respectively to respective upper portions of the doors 30 at pivot pins 280 and 282. The lever means just described may be utilized at opposite longitudinal ends of the doors and may be identical in structure. Accordingly, only one set of the lever means will be described herein.

Figure 8A:
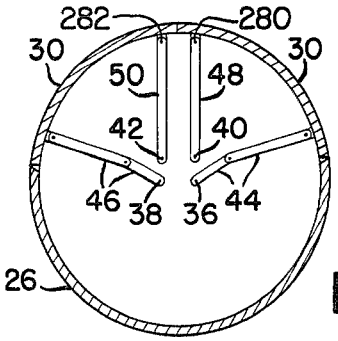
FIG. 8*a* is a cross-sectional schematic illustration of one end portion of the hangar illustrating the pair of doors and corresponding levers in a closed, locked position.
Figure 8B:
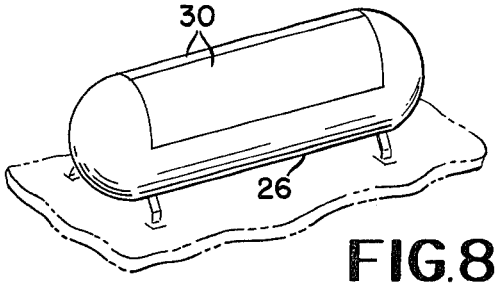
FIG. 8*b* is an isometric illustration of the hangar with the door positions corresponding to the door positions shown in FIG. 8*a*.
Figure 9A:
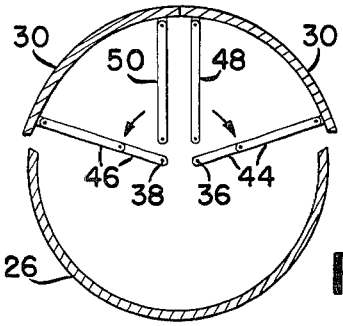
FIG. 9*a* is a cross-sectional, schematic illustration of the doors and levers in an unlocking position.
Figure 9B:
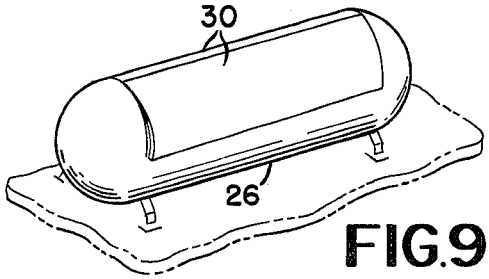
FIG. 9*b* is an isometric illustration of the hangar with the door positions corresponding to the door positions shown in FIG. 9*a*.
Figure 10A:
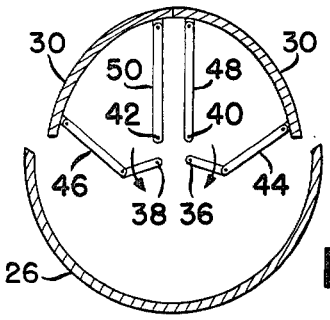
FIG. 10*a* is a cross-sectional, schematic illustration of the doors and levers in an unlocked and opening position.
Figure 10B:
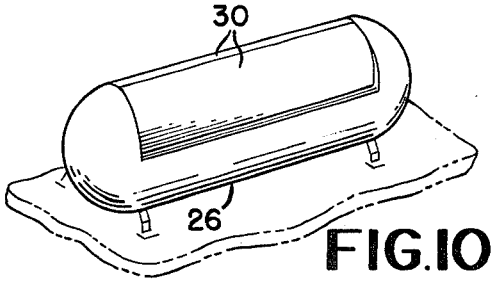
FIG. 10*b* is an isometric illustration of the hangar with the door positions corresponding to the door positions shown in FIG. 10*a*.

In FIG. 8*a* the toggle jointed arms 44 and 46 are in a locked position for the doors 30. When the toggle jointed arms 44 and 46 are moved downwardly, they will first extend to respective, aligned positions which will extend the respective lower portions of the doors beyond the outer surfaces of the cylindrical container (see FIG. 9). As the toggle jointed arms 46 are further rotated downwardly, the doors will move inwardly to the positions as illustrated in FIG. 10*a*. The toggle jointed arms 44 and 46 lock the doors 30 in the up positions in FIG. 8*a* and unlock the doors 30 when driven past the aligned centered positions to the down positions of FIG. 10*a*. It should be noted that the actuator arm output shafts 40 and 42 are located above the longitudinal axis of the container 26 so that when the actuator arms 48 and 50 are moved downwardly the upper portions of the doors are moved inwardly (see FIGS. 11*a* and 12*a*).

DRIVE MEANS

Figure 11A:
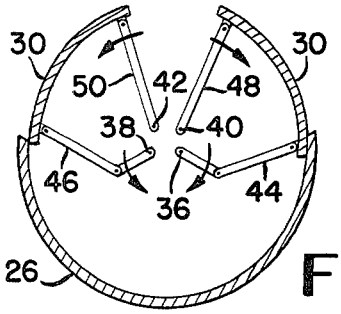
FIG. 11*a* is a cross-sectional, schematic illustration of the doors and the levers in a further opened position.
Figure 11B:
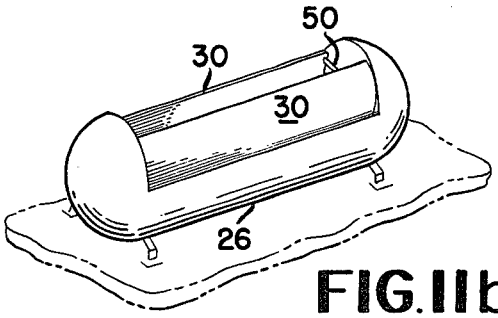
FIG. 11*b* is an isometric illustration of the hangar with the door positions corresponding to the door positions shown in FIG. 11*a*.
Figure 12A:
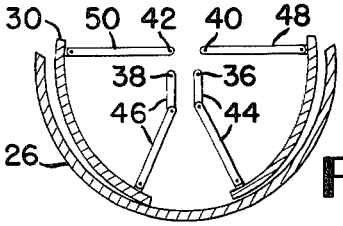
FIG. 12*a* is a cross-sectional, schematic illustration of the doors and the levers in a fully opened position.
Figure 12B:
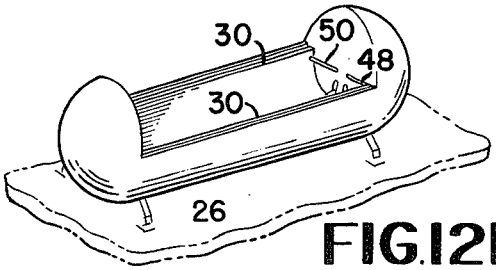
FIG. 12*b* is an isometric illustration of the hangar with the door positions corresponding to the door positions shown in FIG. 12*a*.

The means for opening the door means 30 inwardly and inside the container may further include drive means 52 (see FIGS. 13 through 15) connected to the lever means 34 for rotating a lower portion of each door for an interval of time prior to rotating respective upper portions of each door. An identical drive means may be employed at each end of the door for driving a respective lever means. With a delay in the rotation of the upper portions of the doors, the lower portions will be the first to move as illustrated in FIG. 10*a*. After the delay or dwell period, the upper portions of the doors will begin to move along with the lower portions, as illustrated in FIG. 11 until such time that the doors are fully opened to an inwardly cupped relationship within the container as illustrated in FIG. 12. In closing the doors the process will be reversed.

Figure 13:
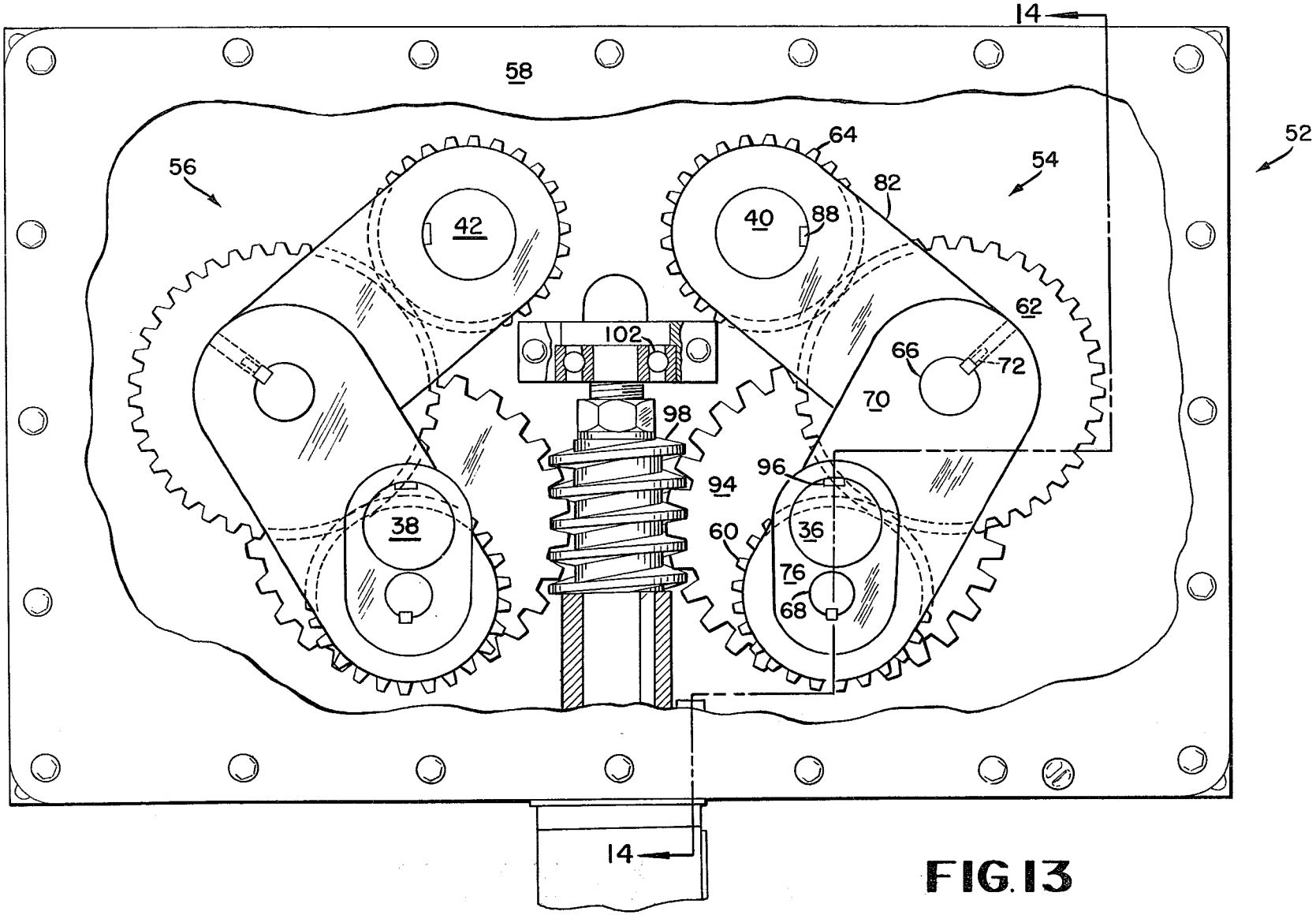
FIG. 13 is an illustration of one of the gear boxes for the hangar with a major portion cut away to illustrate various gear mechanisms therein.
Figure 14:
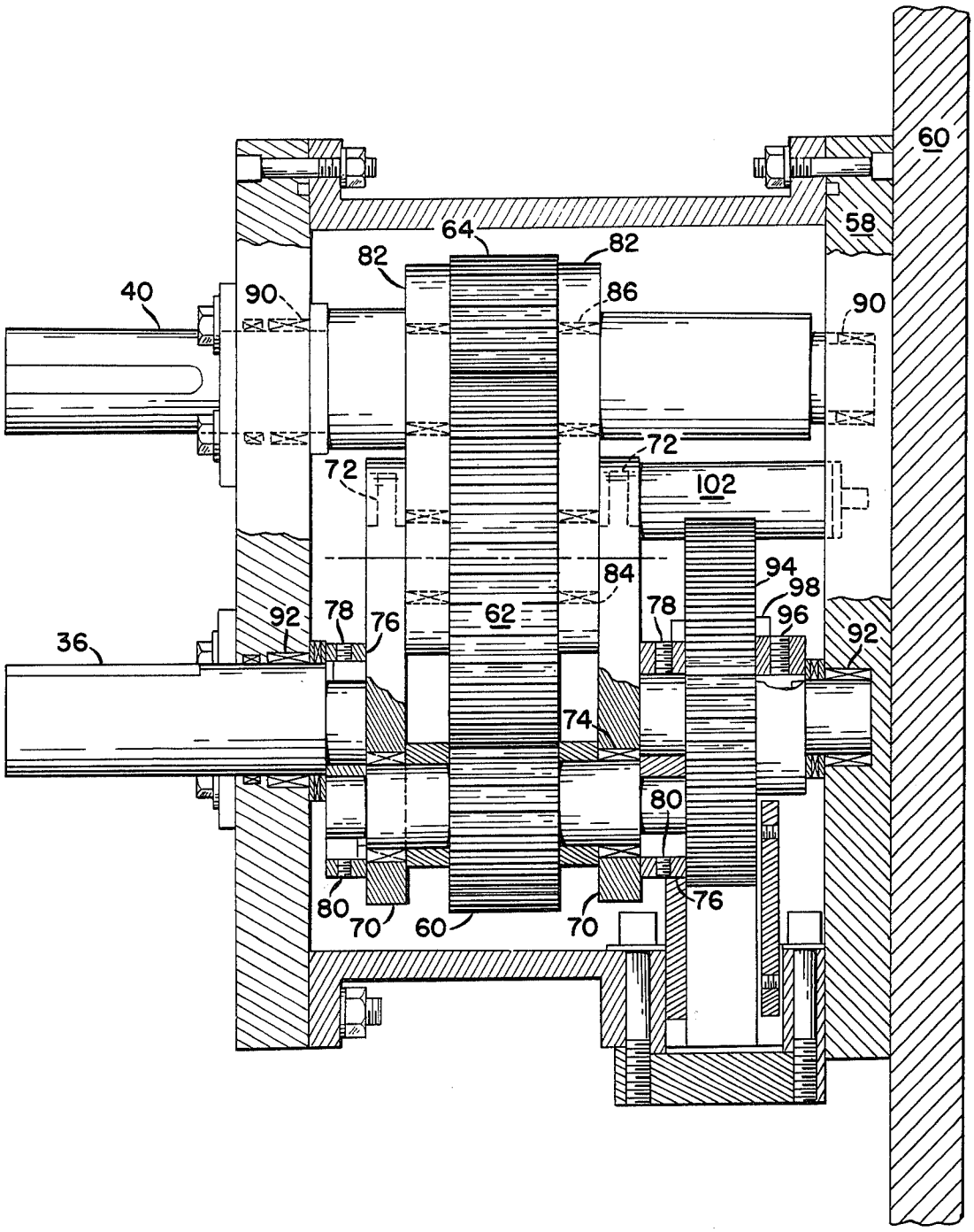
FIG. 14 is an elevation view with certain portions broken away and others shown in section of the gear box of FIG. 13.
Figure 15:
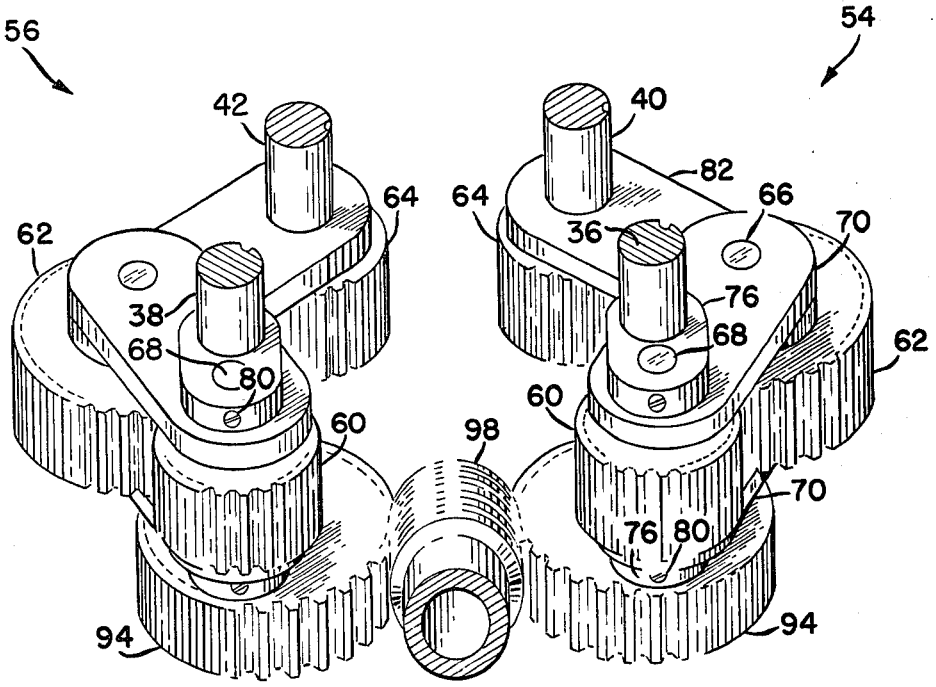
FIG. 15 is an isometric view of the gears removed from the gear box of FIG. 13.

As illustrated in FIGS. 13 through 15, each drive means 52 may include a pair of three gear drive mechanisms 54 and 56. Each pair of three gear drive mechanisms may be mounted in a respective gear case 58 which may be mounted to a respective end plate 60 in the end portions of the cylindrical container (see FIG. 4). Since the three gear drive mechanisms may be identical, only the right three gear drive mechanism 54 shown on the right in the figures will be described herein.

The three gear drive mechanism 54 may include a drive gear 60, an idler gear 62, and a driven gear 64. The drive gear 60 is fixedly connected to a toggle arm output shaft 36, and each driven gear 64 is fixedly connected to a respective actuator arm output shaft 40. The idler gear 62 meshes with the set of drive and driven gears 60 and 64.

The idler gear 62 is mounted for oscillatory movement about both the respective toggle arm shaft 36 and the respective actuator arm shaft 40. In order to accomplish the oscillatory movement about the toggle arm shaft 36 the idler gear is provided with oppositely disposed fixed center pins 66 and the drive gear 60 is provided with oppositely disposed center pins 68. A pair of arms 70 are also provided with one end of each lever arm 70 fixedly connected to a respective idler gear center pin 66 by any suitable means, such as a set screw 72, and the other end of each lever arm pivotably mounted about a respective drive gear center pin 68 by any suitably means such as bearings 74. In turn, the drive gear 60 may be fixedly attached to the toggle arm output shaft 36 by a pair of crank arms 76. The shaft 36, which may be divided for movement of the drive gear 60 therebetween, may be fixedly attached to a respective end of each arm 76 by suitable means such as set screws 78. The other end of each arm 76 may be connected to a respective drive gear center pin 68 by a suitable means, such as set screws 80. In essence the shaft 36, arms 76, and pins 68 (see FIG. 15) function as a crankshaft assembly with the shaft 36 fixed in position and the center of gear 60 fixed between the arms 76 and carried by the throw thereof. It can now best be visualized from FIG. 15 that the idler gear 62 will rotate about the pin 68 and oscillate about the shaft 36 as the drive gear 60 rotates fixedly with the shaft 36. Further, the angular speed of rotation of the idler gear 62 about its axis 66 will vary as it meshes with the drive gear 60, depending upon the angular position of the drive gear 60 about the shaft 36. It is this variation in angular speed of the gear 62 that causes a dwell in the rotation of gear 64 and a corresponding delay in the movement of the upper portions of the doors 30 as seen in FIGS. 8 through 10*a*.

In order to obtain back and forth rocking movement of the idler gear center 66 about the actuator arm shaft 40, a pair of lever arms 82 are provided, one end of each lever arm being pivotally connected to a respective idler gear center pin 66 by any suitable means such as bearings 84, and the other end of each lever arm 82 being pivotably connected to opposite ends of the actuator shaft 40 by any suitable means, such as bearings 86. As illustrated in FIG. 14, the driven gear 64 is fixedly connected to the actuator arm output shaft 40 by any suitable means, such as key 88, and the shaft 40 is in turn rotatably mounted in the gear casing 58 by any suitable means such as bearings 90. The toggle arm shaft 36 may in a similar manner be mounted in the gear case 58 by any suitable means such as bearings 92. With the arrangement just described for the three gear mechanism, the actuator shaft 40 will rotate at varying speeds as the idler gear 62 arcs about shaft 40 and rotates and oscillates about shaft 36.

The equations for designing desired dwell movements of the three gear drives may be found in: (1) an article entitled "New Equations Locate Dwell Position of 3-Gear Drives", by Dr. J. Hirschhorn in the June 8, 1959 issue of Product Engineering; and (2) an article entitled "Kinematics of Intermittent Mechanisms IV-The Three Gear Drive", by S, Rappaport, in the January, 1950 issue of Product Engineering. The desired dwell for driven gear 64, of the drive means, is substantially a zero dwell for an interval of time during rotary movement (about 4) of the drive gear 60. As illustrated in FIG. 10*a*, it is desired that this zero dwell occur during initial downward movement of the doors 30 so that the lower portions of the doors open first, to be followed subsequently by downward movement of the upper portions of the doors.

In order to apply driving power to the three gear drive 54, a worm wheel 94 may be fixedly attached to the toggle arm shaft 36 by any suitable means, such as key 96. The worm wheel 94 as well as the worm wheel for the other three gear drive 56 may be driven by a worm gear 98 which is rotably mounted in the gear case 58 by any suitable means such as bearings 100 and 102 (see FIGS. 13 and 14). The worm gear of each gear case at each end of the container is connected to a respective motor 104 and 106, as illustrated in FIG. 16.

ELEVATOR MEANS

As stated hereinabove, the docking system 20 may further include the elevator means 32 for raising and lowering the underwater vehicle 22 through the top of the container when the door means 30 are open. As illustrated in FIG. 5, it is preferred that the elevator means 32 raise the vehicle 22 to an inclined position with the bow of the vehicle above the stern of the vehicle. This is important for the purpose of getting the forward hydrodynamic controls 108 of the vehicle into the flow stream to establish a preferred lift for safe and efficient departure of the vehicle from the docking system 20. As illustrated in FIG. 2 and FIGS. 5 through 7, the elevator means may include an elongated platform 110 of rails which is disposed in the container 26, and which has bow and stern ends 112 and 114 respectively, which correspond to the bow and stern ends of the underwater vehicle 22.

The elevator means may also include first lever means 116 which pivotably interconnect a stern end portion of the platform 110 to the bottom of the container, and second lever means 118, which is longer than the first lever means 116, for interconnecting a bow end portion of the platform 110 to the bottom of the container. The elevator means further includes elongated telescopic means 120 which is pivotably connected at one end to the bottom of the container and is pivotably connected at the opposite end to the platform 110 between the pivotable connections of the first and second lever means 116 and 118. The vehicle 22 rests on the platform 110 and is releasably attached thereto by hook-up means 122.

Figure 4:
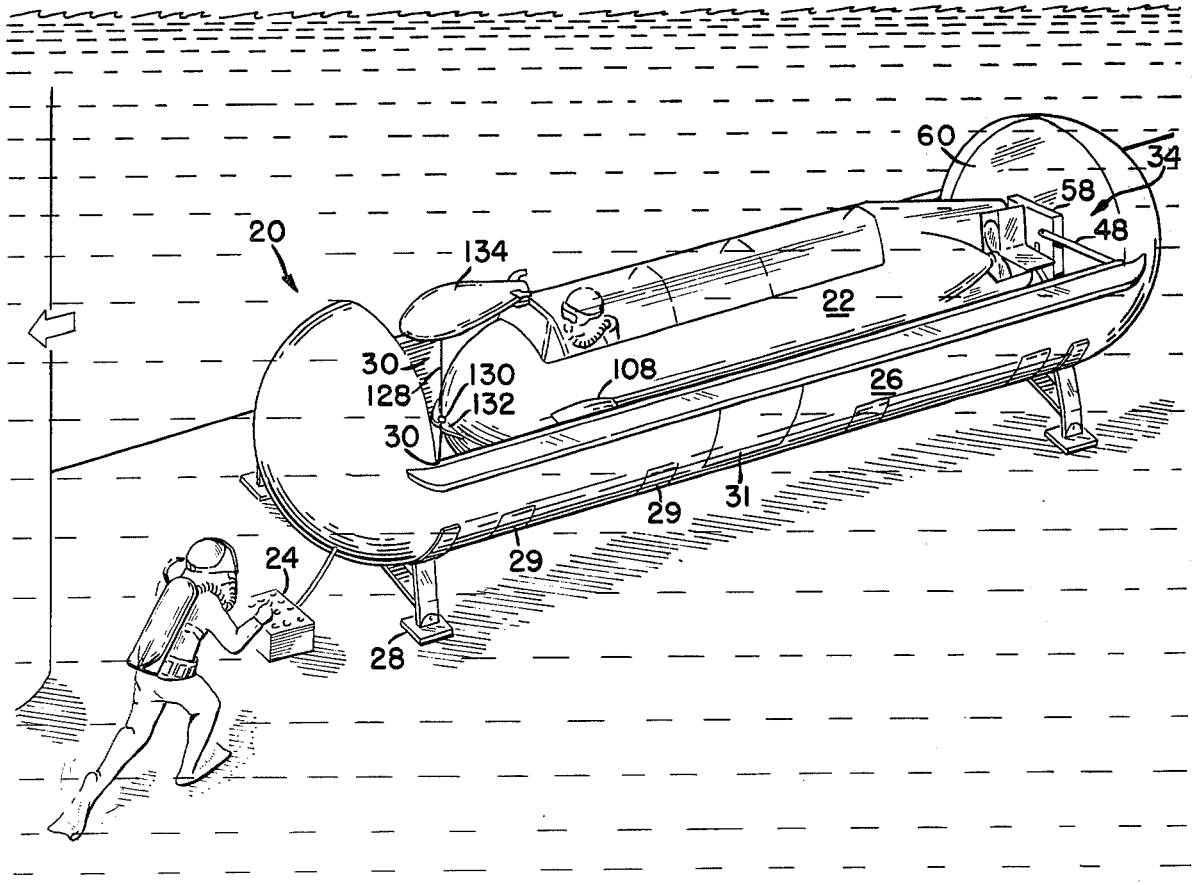
FIG. 4 is an isometric view of the hangar in an open position with the underwater vehicle exposed.

When the telescoping means 120 is in its retracted position, as shown in FIGS. 2 and 4, the vehicle 22 is entirely contained within the container 26, and when the telescoping means 120 is fully extended the vehicle 22 is elevated out of the container 26 with its bow end up as illustrated in phantom in FIG. 2 and as illustrated in FIG. 5. The lever means 116 and 118 may each be a pair of lever arms which are pivoted to opposite sides of the platform, as illustrated in FIG. 5, and the telescoping means 120 may be a telescoping hydraulic cylinder which is operated by a power means which is illustrated in FIG. 16.

Figure 7:
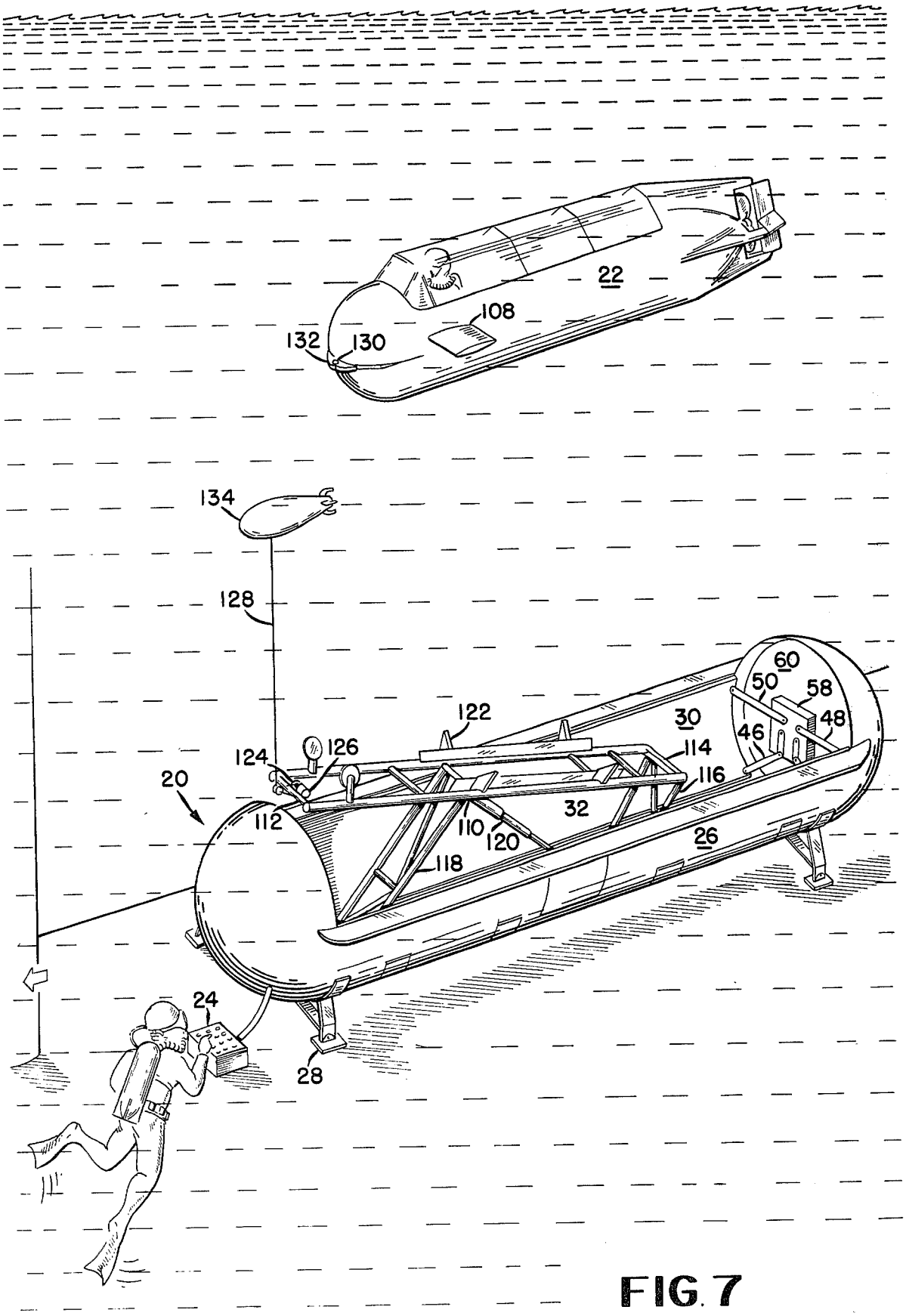
FIG. 7 is an isometric view of the hangar with the underwater vehicle released therefrom for its journey to a desired destination.

For drawing down or releasing the vehicle 22 a winch means, which may include a winch 124 and a motor 126, may be mounted on the bow end portion of the platform 110. A cable 128, which winds on the winch 124, may be provided with a catch ball 130 which can be lodged within a retrieval mechanism 132 on the bow end of the vehicle 22. At the upper end of the cable 128 is a float 134. This release and retrieval system, which is described in detail in U.S. Pat. No. 3,757,722, can be utilized to pay out the vehicle, as illustrated in FIG. 6, and ultimately release the vehicle, as illustrated in FIG. 7. To return to the docking system 20, the retrieval system 132 of the vehicle is utilized for capturing the cable 128 and lodging the ball 132 at the bow of the vehicle so that the vehicle can be winched back down to the platform 110.

HYDRAULIC POWER AND CONTROL SYSTEM

The present invention is a hydraulic power and control system for operating exterior components, such as the exemplary docking system 20 described hereinabove. The hydraulic power and control system can be utilized for selectively actuating the door means 30, the elevator raising and lowering means 32, and the winch means 124. This hydraulic power and control system is illustrated schematically in FIGS. 16*a* and 16*b*. The hydraulic power and control system may include pump means 136 which has an inlet 138 and an outlet 140 which are mounted in a liquid sealed housing 142 so that the pump inlet 140 is located for intake within the housing. The hydraulic power and control system may further include pilot operated power valve means 144 which has an inlet port 146 and outlet and return ports 148. First conduit means 150 may connect the outlet 140 of the pump means to the inlet port 146 of the pilot operated power valve means, and second conduit means 152 may be connected to the outlet port 148 of the pilot operated power valve means for discharging liquid from the outlet port into the sealed housing 142.

The hydraulic power and control system may further include control valve means 154 which has inlet, outlet, and return ports 156, 158, and 160 respectively. Third conduit means 162 may connect the outlet port 158 of the control valve means to the pilot operated valve means 144 for pilot operation of the pilot operated valve means. Fourth conduit means 164 may connect the inlet port 156 of the control valve means to the outlet port 140 of the pump means. Fifth conduit means 166 may be connected to the return port 160 of the control valve means via 218 and 220 for discharging liquid from the return port into the sealed housing 142.

The pilot operated valve means 144, which may be a spring centered, four way directional valve, is preferably located within the sealed housing 142. Sixth conduit means 168 may be connected to the outlet and return ports 148 of the power valve means and may sealably extend through the sealed housing 142 at 170 for operation of the hydraulic motors 104 and 106. The sixth conduit means 168 connects the outlet port of the power valve means to the inlet of one of the hydraulic motors and further on the return port of the power valve means 144 to the outlet of the other hydraulic motor. Which conduit of the sixth conduit means 168 is a supply or return line depends upon the position of the power valve means 144 since the outlet and return ports 148 will alternate in their roles depending upon the control by the control valve means 154. The remaining outlet port of one of the hydraulic motors is connected in series with the remaining inlet port of the other hydraulic motor by a seventh conduit means 172. The seventh conduit means 172 also extends sealably through the sealed housing 142 at 170. Pressure relief means 174, which is preferably located within the sealed housing 142, is connected to the inlet and outlet ports of both hydraulic motors 104 and 106 for bypassing liquid from one hydraulic motor to the other should either hydraulic motor lock against further motive operation. For example, should motor 106 complete its operation prior to motor 104 the fluid would be bypassed to 104 to maintain its operation until it has completed its function, or vice versa depending upon the control of the power valve 144.

Two more pilot operated power valve means 176 and 178 which may be identical to power valve means 144, may be located within the sealed housing 142 for operation of the hydraulic telescoping cylinder 120 and the winch motor 126 respectively. Similar conduit means may extend sealably through the housing to perform these hydraulic functions and flow control means 180 and 182 may be located within the respective conduits for controlling the flow to the components.

All of the pilot operated power valve means 144, 176, 178, as well as the pump means 136 are located within the sealed housing 142 which is adapted to contain a liquid, such as oil. Means 184 are operatively connected to the sealed housing 142 by a conduit 186 for pressure compensating the housing 142 with ambient. Accordingly, as the sealed housing is taken to a depth pressure within the ocean the means 184 will pressure compensate and make the oil pressure within the sealed housing the same as the exterior water pressure. The pressure compensating means 184 may be a Bellofram compensator as illustrated in FIG. 16. The pump means 136 may have a drive shaft 188 which sealably extends through the sealed housing 142 at 190, and which is connected exteriorly thereto to an electric motor 192. The electric motor 192 may be powered by a battery 194, and may be selectively actuated or stopped by a push button switch 196.

The control valve means has been described hereinabove at 154 in conjunction with the power valve means 144, and may be utilized specifically for starting the opening of the doors 30. The control valve means may be duplicated at 198 for starting the closing of the doors, at 200 for starting the elevator 110 in the up mode, at 202 for starting the elevator in the down mode, at 204 for starting the winch 126 in the up mode, and at 206 for starting the winch in the down mode. All of the control valve means may be located within the control panel 24 which is a pressure casing. The pressure casing 24 may have passageways which communicate with the ports of the control valve means and which are sealably conneccted to the third, fourth, and fifth conduit means 162, 164, and 166, respectively. In order to facilitate easy operation of the control valve means by reducing and stabilizing the liquid pressure thereto, a pressure reducing valve 208 and an accumulator 210 may be located within the sealed housing 142 and connected to the fourth conduit means 164.

It is desirable that the control valve means, shown exemplarily at 154, be a push button type valve with a push button 212 sealably extending through the sealed casing 24 and located exteriorly thereof for manual operation by a diver. Further, the valve means 154 is preferably a normally closed two position, three-way valve with at least one pilot port 214, the pilot port 214 being connected to the outlet of the valve so that when the valve is opened it will stay open until liquid pressure to the inlet port 156 of the valve is terminated. To terminate the liquid pressure to the inlet port 156 it is desirable to use a normally open two position, three-way push button valve 216 which has an outlet port 218 which is connected to the inlet port 156 of the normally closed valve 154. The normally open valve 216 may have an inlet port 220 which is connected to the conduit means 164 and a return port 222 which is connected to the conduit means 166. it should be noted that when the push button 224 of the normally open valve 216 is pushed that liquid pressure to the valve 154 is cut off so that when the valve 154 is open it will be automatically closed to its normally closed position. Accordingly, when the push button 224 is pushed the doors 30 will be stopped from their opening mode. The push button 224 also sealably extends through the pressure casing 24 for operation by a diver.

Other normally open valves identical to the normally open valve 216 may be connected to the respective normally closed valves, such as valve 226 which may be connected to normally closed valve 198 for stopping the closing mode of the doors 30, valve 228 which is connected to valve 200 for stopping the up mode of the elevator 110, valve 230 which is connected to valve 202 for stopping the down mode of the elevator 110, valve 232 which is connected to valve 204 for stopping the up mode of the winch 126, and valve 234 which is connected to the valve 206 for stopping the down mode of winch 126.

It is desirable that some of the normally open valves, such as valve 228, have at least one pilot port 236. In conjunction with this, it is further desirable that a mechanically operated, normally closed limit valve 238 be employed which can be engaged and actuated by a movable device. The valve 238 may be mounted on an upper forward portion of the container 26 to engage with the elevator 110 in its ultimate up position for actuating the valve 238. The limit valve 238 may have an inlet port 240 which is connected to the fourth conduit means, a return port 242 which is connected to the fifth conduit means 166, and an outlet port 244 which is connected to the pilot port 236 of the normally open valve 228. Accordingly, when the elevator 32 has risen to the up engaging position with the limit valve 238 the normally open valve 228 is closed so as to stop the up mode of the elevator 110.

Further, the normally open valve 228 may operate in conjunction with the normally open valve 226. Both valves 226 and 228 have a pair of pilot ports. The pilot port 236 of valve 228 may be connected to a pilot port 246 of the valve 226 and the valve 228 may have a pilot port 248 connected to a pilot port 250 of the valve 226. In this manner, the pilot port 236 of valve 228 and the pilot port 246 of valve 226 will be connected to the outlet port 224 of the limit valve 238. Another identical limit valve 252 may be provided which has an outlet port 254 which is connected to the pilot port 250 of valve 226 and pilot port 248 to valve 228. The limit valve 252 may be connected to the fourth conduit means 164 and the fifth conduit means 166 in the same manner as described for the limit valve 244. The limit valve 252 may be mounted at one end of the container 26 for engaging one end portion of the doors 30 when they go into their ultimate closed positions. With this arrangement, the mechanical operation of either limit valves 238 or 252 will stop the up modes of both the elevator 110 and the closing mode of the doors 30.

In a similar manner an identical limit valve 256 may be mounted at the opposite end of the container for engaging the doors when they go into ultimate closed positions so as to perform the same function. Identical limit valves 258 and 260 may be mounted at opposite ends of the container 26 in a lower portion for receiving opposite ends of the doors 30 when they completely open, and may be connected to a pilot port of the normally open valve 216 for stopping the opening mode of the doors. Another identical limit valve 262 may be mounted in the container 26 in a forward position for engaging the elevator 110 when it is in its ultimate down position, and may be connected to a pilot port of normally open valve 230 for stopping the down mode of the elevator 110.

Identical limit valve 264 may be mounted in the container for engagement with the elevator 110 in its up position (see phantom line in FIG. 16*a*) and may be connected to a pilot port of normally open valve 228 for stopping the up mode of the elevator 110.

Obviously, many modifications and variations of the present invention are possible in the light of the above teachings, and, it is therefore understood that the invention may be practiced otherwise than as specifically described.

I claim:

1. A hydraulic power and control system comprising:
pump means having an inlet and an outlet;
a sealed housing;
the pump means being mounted in said housing with the pump inlet being located for intake of liquid from within the housing;
pilot operated power valve means being located in the sealed housing and having inlet, outlet, and return ports therein;
first conduit means connecting the outlet of the pump means to the inlet port of the pilot operated power valve means;
second conduit means connected to the outlet port of the pilot operated power valve means for discharging liquid from the outlet port into the sealed housing;
control valve means having inlet, outlet, and return ports;
third conduit means connecting the outlet port of the control valve means to the pilot operated valve means for pilot operation of said pilot operated valve means;
fourth conduit means connecting the inlet port of the control valve means to the outlet port of the pump means; and
fifth conduit means connected to the return port of the control valve means for discharging liquid from the return port into said sealed housing.

2. A hydraulic power and control system as claimed in claim 1 including:
means operatively connected to the sealed housing for pressure compensating the housing with the pressure outside the housing.

3. A hydraulic power and control system as claimed in claim 1 including:
said pump means having a drive shaft which sealably extends through the sealed housing.

4. A hydraulic power and control system as claimed in claim 1 including:
a pressure reducing valve and an accumulator located within the sealed housing and connected in the fourth conduit means for reducing and stabilizing pressure to the control valve means.

5. A hydraulic power and control system as claimed in claim 1 including:
a pressure casing which is located outside the sealed housing;
said control valve means being mounted in the pressure casing;
said pressure casing having passageways which communicate with the ports of the control valve means and which are sealably connected to the third, fourth, and fifth conduit means; and
said third, fourth, and fifth conduit means sealably extending through the sealed housing.

6. A hydraulic power and control system as claimed in claim 5 including:

said control valve means being at least one push button valve; and the push button of the control valve means being located exteriorly of the casing and sealably extending therethrough.

7. A hydraulic power and control system as claimed in claim 5 including:

a pressure reducing valve and an accumulator located within the sealed housing and connected in the fourth conduit means for reducing and stabilizing pressure to the control valve means.

8. A hydraulic power and control system as claimed in claim 1 wherein the control valve means includes:

at least one normally closed, two position pilot three way valve with at least one pilot port which is connected to the outlet of the valve so that when the valve is opened it will stay open until liquid pressure to the inlet port of the valve is terminated; and at least one normally open two position three way valve which has its outlet port connected to the inlet port of the normally closed valve so that the normally closed valve will automatically go from an open position to a closed position when the normally open valve is closed.

9. A hydraulic power and control system as claimed in claim 8 wherein the control valve means further includes:

the normally open valve having at least one pilot port;

at least one mechanically operated normally closed two position limit valve which can be engaged and actuated by a movable device and which has inlet, outlet, and return ports; and the outlet of the limit valve being connected to the pilot port of the normally open valve and the inlet of the limit valve being connected to the fourth conduit means.

10. A hydraulic power and control system as claimed in claim 9 including:

the control valve means including another set of valves comprising another normally closed, two position, three way valve, and another mechanically operated normally closed, two position limit valve which are all interconnected in the same manner as the first mentioned set;

the normally open valves of each set having an additional pilot port; and each pilot port of each normally open valve being connected to a respective pilot port of the other normally open valve so that actuation of either limit valve will close both normally open valves.

11. A hydraulic power and control system as claimed in claim 9 including:

a pressure casing which is located outside the sealed housing;

the normally closed, two position, three way valve and the normally open two position, three way valve being mounted in the pressure casing;

said pressure casing having passageways which communicate with the ports of the control valve means and which are sealably connected to the third, fourth, and fifth conduit means;

said third, fourth, and fifth conduit means sealably extending through the sealed housing; and the pump means being adapted to intake liquid within the sealed housing.

12. A hydraulic power and control system as claimed in claim 11 including:

the normally closed two position, three way valve and the normally open two position, three way valve being push button valves, and the push buttons being located exteriorly the pressure casing and sealably extending therethrough.

13. A hydraulic power and control system as claimed in claim 12 including:

a pressure reducing valve and an accumulator located within the sealed housing and connected in the fourth conduit means for reducing and stabilizing pressure to the control valve means.

14. A hydraulic power and control system as claimed in claim 13 including:

a sixth conduit means connected to the outlet and return ports of the power valve means and sealably extending through the sealed housing for operation of a hydraulic motor means; and means operatively connected to the sealed housing for pressure compensating the housing with the pressure outside of the housing.

15. A hydraulic power and control system as claimed in claim 14 including:

the hydraulic motor means being a pair of hydraulic motors located exterior of the sealed housing;

said sixth conduit means connecting the outlet port of the power valve means to the inlet of one of the hydraulic motors and the return port of the power valve means to the outlet of the other hydraulic motor;

the remaining outlet port of the one hyraulic motor being connected in series with the remaining inlet port of the other hydraulic motor; and pressure relief means connected to the inlet and outlet ports of both hydraulic motors for bypassing liquid from one hydraulic motor to the other should either hydraulic motor lock against further motive operation.

16. A hydraulic power and control system as claimed in claim 15 including:

said power valve means being a pilot operated spring centered four way directional valve.

17. A hydraulic power and control system as claimed in claim 16 including:

said pump means having a drive shaft which sealably extends through the sealed housing.

18. A hydraulic power and control system comprising:

a sealed housing:

pump means and power valve means mounted within the sealed housing;

means for pressure compensating the interior of the sealed housing relative to the pressure outside the sealed housing;

control valve means for pilot operating the power valve means;

the power valve means and the control valve means being connected in parallel to the pump means for fluid communication;

means for reducing hydraulic pressure from the pump means to the control valve means;

the pump means being adapted to intake liquid within the sealed housing;

the power valve means being adapted to discharge liquid within the sealed housing; and the control valve means being adapted to discharge liquid within the sealed housing.

19. A hydraulic power and control system as claimed in claim 18 including:

a pressure casing;

the control valve means being mounted within the pressure casing; and the control valve means having push button valve actuating means which sealably extends through the pressure casing.

* * * * *